US005242485A

United States Patent [19]

Dittrich

[11] Patent Number: 5,242,485

[45] Date of Patent: Sep. 7, 1993

[54] PROCESS AND APPARATUS FOR VACUUM TREATMENT OF METALS

[75] Inventor: Rainer Dittrich, Duisberg, Fed. Rep. of Germany

[73] Assignee: Mannesmann AG, Dusseldorf, Fed. Rep. of Germany

[21] Appl. No.: 752,654

[22] PCT Filed: Feb. 20, 1990

[86] PCT No.: PCT/DE90/00121

§ 371 Date: Aug. 22, 1991

§ 102(e) Date: Aug. 22, 1991

[87] PCT Pub. No.: WO90/10087

PCT Pub. Date: Sep. 7, 1990

[30] Foreign Application Priority Data

Feb. 24, 1989 [DE] Fed. Rep. of Germany ..... 3906340

[51] Int. Cl.[5] ..... C21C 7/10

[52] U.S. Cl. ..... 75/510; 266/209

[58] Field of Search ..... 266/44, 208, 209, 210, 266/211; 75/508, 510

[56] References Cited

U.S. PATENT DOCUMENTS 3,650,517 3/1972 Messing ..... 266/211

3,975,004 8/1976 Okada et al. ..... 266/210

*Primary Examiner*—Scott Kastler

*Attorney, Agent, or Firm*—Nils H. Ljungman & Associates

[57] ABSTRACT

A process and apparatus for the vacuum treatment of metals. In a tightly sealed vacuum treatment vessel, molten metal is preferably divided, on the surface, into a generally circular sector and a generally ring-shaped sector surrounding the generally circular sector. Preferably, each sector of the molten metal is exposed to different vacuum pressures during vacuum treatment, wherein a generally lower vacuum pressure is applied to the ring-shaped sector than to the circular sector. The two sectors are preferably separated to an immersion depth, in the molten bath, of between 10 and about 20 cm, as measured starting from the ring-shaped sector.

20 Claims, 4 Drawing Sheets

PROCESS AND APPARATUS FOR VACUUM TREATMENT OF METALS

BACKGROUND OF THE INVENTION

1. Field of the Invention

This invention relates to a process and an apparatus for the vacuum treatment of metals, in particular steel.

2. Background Information

During ladle degassing, the tapping ladle filled with steel is lowered into a large cylindrical chamber, and this chamber is then sealed vacuum tight by a cover. The seal is generally a rubber ring. The covers are manufactured either of steel castings or of sheet metal structures. On the underside of the cover there is an ejector protector made of sheet metal and/or refractory tamping clay. Alloy addition devices and viewing ports are located on the cover.

The vacuum is generally generated by at least four ejectors. When molten steel is exposed to a vacuum pressure, gas bubbles form inside the steel at a pressure which is a function of the internal pressure above the surface of the bath. Unkilled steel with a high oxygen content experiences an agitation action as a result of the formation of carbon monoxide even at pressures of less than 200 Torr in the open space of the vacuum treatment vessel, and thus simultaneously flushes the hydrogen and nitrogen out of the molten metal, so that even with this relatively weak vacuum a removal of gases occurs. As the pressure is further reduced, the agitation can become vigorous, so that for example, the molten steel can rise one meter and more in the ladle. Sufficient room for the steel to rise must be provided by the selection of a rather large ladle is necessary, and therefore the ladle cannot be filled to its edge, rather it must have a certain freeboard. In existing steel mills, the ladle sizes and weights when full are determined as a function of the crane equipment. As a result of the need for the freeboard, the ladles can no longer be filled to the rim, which has the disadvantage of reducing production. The alternative solution, of enlarging the ladles, means that the hoisting apparatus and the pick-up equipment must be adjusted to the increased weight to be transported.

An absorption vessel independent of the ladle offers an additional solution. DE-OS 20 32 830 discloses a plunger, which is immersed with the open side down in the molten metal, and its inside is then evacuated. This plunger has the disadvantage that it must be pushed into the molten metal to achieve the required depth of immersion during the vacuum treatment. After the vacuum pressure is established, the level of the surface of the molten metal rises by the barometric differential, which can be much more than 1 meter, while the level of the molten metal not affected by the vacuum drops by a similar amount. As a result of the enclosure of molten metal in the plunger, which is smaller than the ladle, a relatively large volume of the molten metal is separated from the molten metal remaining in the ladle, with the disadvantage that the two portions of the molten metal are exposed to different vacuum treatments.

DE-AS 19 65 136 discloses an apparatus for the ladle degassing of molten metals, in which a reaction tube located underneath the cover of the vacuum treatment vessel can be immersed in the molten metal. In a complex manner, a lance with reactive gases is guided into the space enclosed by the reaction tube for the metallurgical treatment, during which the degassing and thus the volume increase of the molten metal is to take place. On account of the uniform vacuum pressure acting on the surface of the molten metal, it is not possible to prevent an increase in volume in the ring-shaped area between the reaction tube and the edge of the ladle.

DE-AS 19 12 907 and 19 19 053 also disclose devices in which gas is introduced into the molten metal through a tubular partition which is immersed in the molten metal. This partition is surrounded in a ring-shaped manner by an additional tubular partition, so that there is a communicating connection between these two partitions. By connection to pressure and/or suction pumps at different pressures, different surface level heights can be obtained in the individual chambers, and ultimately this leads to an improved flow of the metal or bath movement.

OBJECT OF THE INVENTION

The object of the invention is to find a process and an apparatus for the vacuum treatment of metals, in particular steel, which eliminate the above-mentioned disadvantages, use simple means, eliminate the requirement for a freeboard in the ladle and do not interfere with the degassing of the melt.

This object is achieved by means of the invention disclosed hereinbelow.

SUMMARY OF THE INVENTION

According to the invention, a structurally simple, relatively small and lightweight skirt is located on the cover of the vacuum treatment vessel. The diameter of this skirt is only slightly smaller than the diameter of the ladle at the level of immersion. The lower, open edge of the skirt is immersed only slightly in the molten metal. The immersed skirt divides the surface of the molten metal into two sectors, one ring-shaped and one circular, to which different vacuum pressures are applied.

The pressure difference can be adjusted as desired. The preferred range is between ½ and 2 pressure stages.

On account of the size of the shield, the radius of which is in a ratio of 8:1 to 122:1 to the width of the ring-shaped sector, there is hardly any interference with the vacuum treatment of the entire amount of the molten metal. This effect is further improved by the fact that the depth of penetration of the skirt is limited to a minimum, and thereby assumes values of 10 to 20 cm. The three-dimensional areas mentioned above and the low depth of immersion of the skirt do not significantly disrupt the flow conditions in the molten metal. This has a particularly advantageous effect with the high flow velocities of the molten metal used in modern installations, caused by the large amount of stirring gas used, which is introduced into the molten metal through up to three porous plugs.

This effect can hardly be improved any further, if the shield is designed to be vertically adjustable, since depending on the level to which the ladle is filled, the immersion depth of the skirt can be adjusted at any stage of the vacuum treatment.

The pressure difference can either be set directly between two pressure stages, or can be continuously adjusted by using a branch with throttles.

BRIEF DESCRIPTION OF THE DRAWINGS

The accompanying drawings contain schematic illustrations of examples of the invention.

DESCRIPTION OF THE PREFERRED EMBODIMENTS

Figure 1:
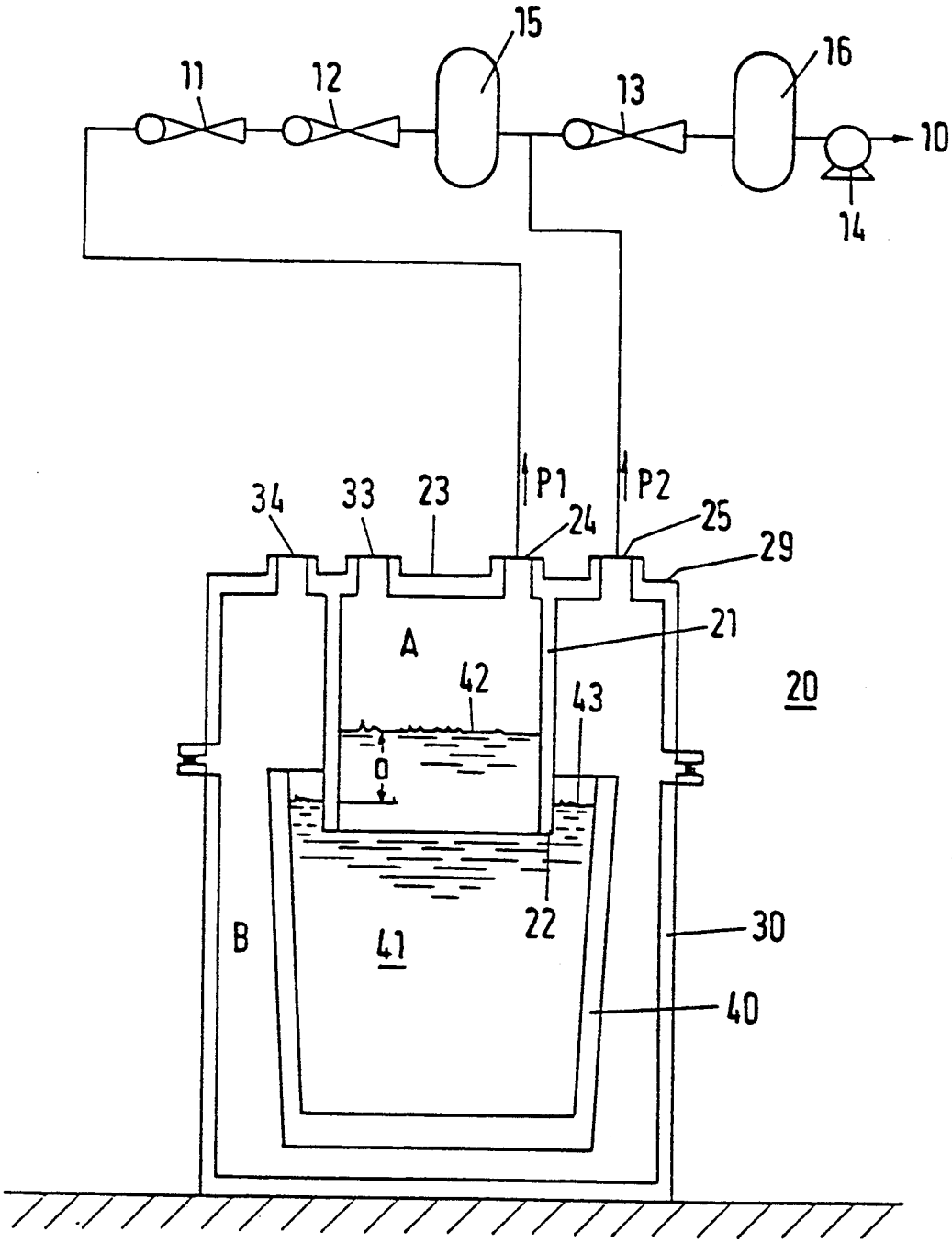
FIG. 1 shows a cross section through the vacuum treatment vessel with a solid cover, with connections to different stages of a vacuum generator.
Figure 1A:
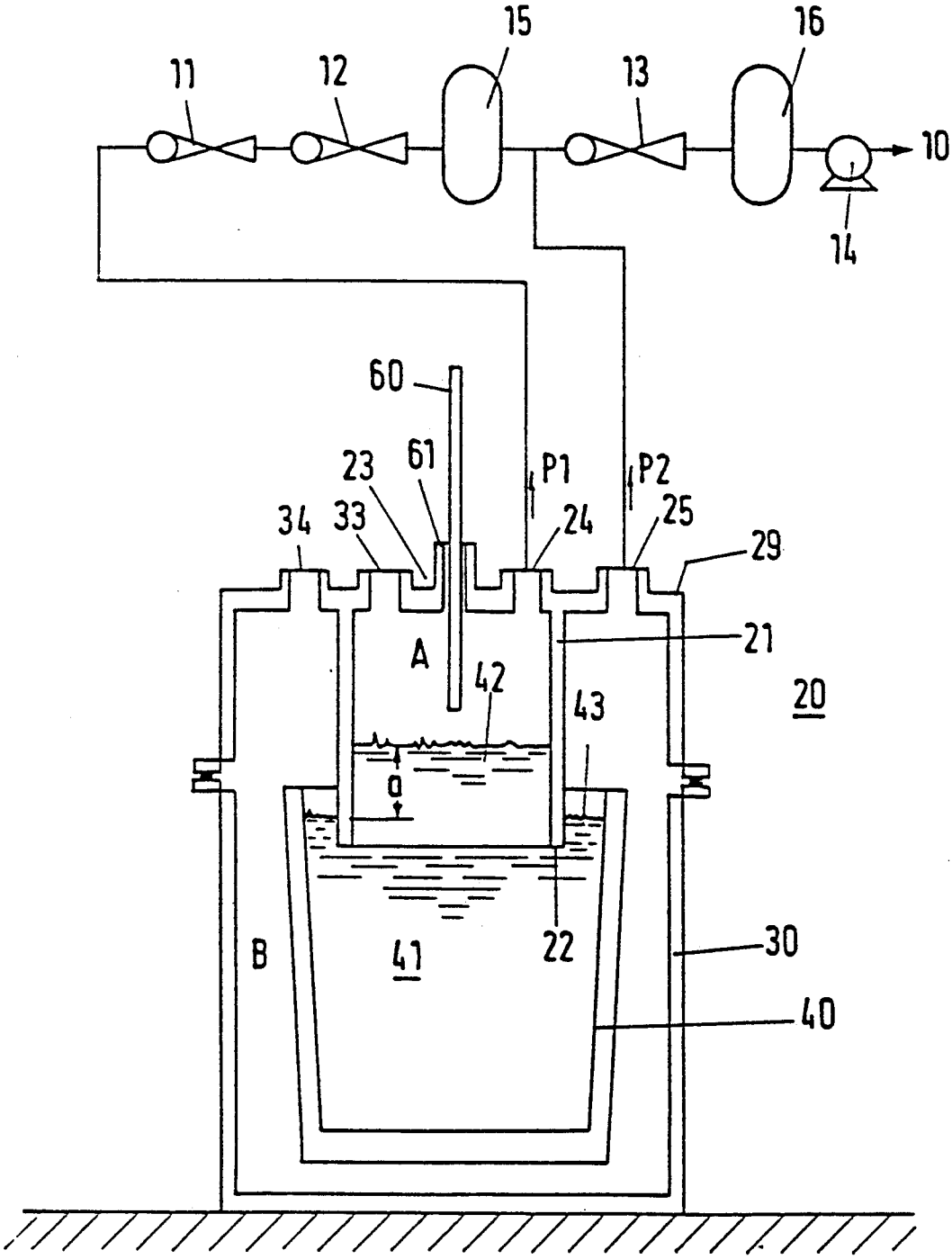
FIG. 1*a*, like FIG. 1, with additional electrode in open space A.

FIGS. 1 and 1*a* show a vacuum treatment vessel 30 with a flange and gasket, on which a cover 20 is placed. In the vacuum treatment vessel 30, there is a ladle 40 filled with molten metal 41. The lower edge 22 of a skirt 21 fastened to the cover 20 is immersed in the molten metal 41.

The skirt 21 immersed in the surface of the molten metal bath divides the latter into a circular segment 42 and a ring-shaped segment 43.

The open space A is enclosed between the circular bath surface 42, the inner jacket of the skirt 21 and the circular portion 23 of the cover 20. The remaining portion of the cover 20, with the ring-shaped part 29, the jacket outside of the skirt 21, the lower portion of the vacuum treatment vessel 30, the outside of the ladle 40 and the ring-shaped surface 43 of the molten metal enclose the open space B.

For viewing the surface 42, 43 of the molten metal, there are viewing ports 33, 34 in the cover 20. The open space A is connected to the vacuum system 10 by means of a connection 24 in the vicinity of the circular cover 23, and the open space B is connected to the vacuum system 10 by means of a connection 25, in the vicinity of the annular portion 29 of the cover.

The vacuum generator 10 has a water ring pump 14, a steam ejector 13 (60 Torr), and between the two a condenser 16. It also has a steam ejector 12 (10 Torr) and a steam ejector 11 (0.5 (Torr), and between the ejectors 12 and 13 there is a condenser 15. The open space A is connected to the maximum vacuum pressure stage p1 of the steam ejector 11, and the open space B in the present case is connected two stages lower p2, between the ejectors 13 and 12.

During the operation of the vacuum generator 10, the height of the circular segment 42 of the molten metal bath surface rises by the amount a in relation to the ring-shaped surface 43.

FIG. 1*a* shows, in addition to the system described above in FIG. 1, an electrode 60, which projects through the electrode duct 61 in the vicinity of the circular cover portion 23 into the open space A.

Figure 2:
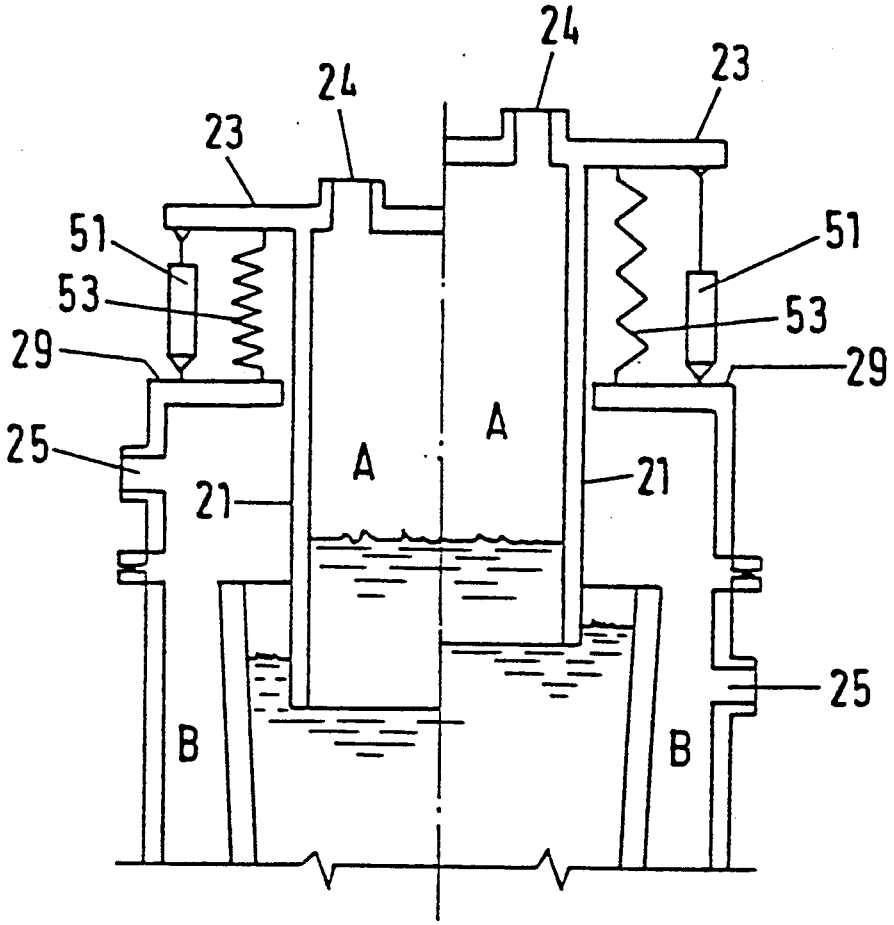
FIG. 2 shows a vacuum treatment vessel with an axially movable skirt.

FIG. 2 is a schematic illustration of a vertically adjustable skirt 21, which is fastened to a circular portion 23 of the cover 20, whereby the circular portion 23 can be adjusted by means of adjustment elements 51 in relation to the ring-shaped portion 29 of the cover 20. For a gas-tight seal there are compensators 53 between the ring-shaped portion 29 and the circular portion 23. The connection 25 to the open space B is located in one case in the cover 20, and in the other case in the lower portion of the vessel of the vacuum treatment vessel 30.

Figure 3:
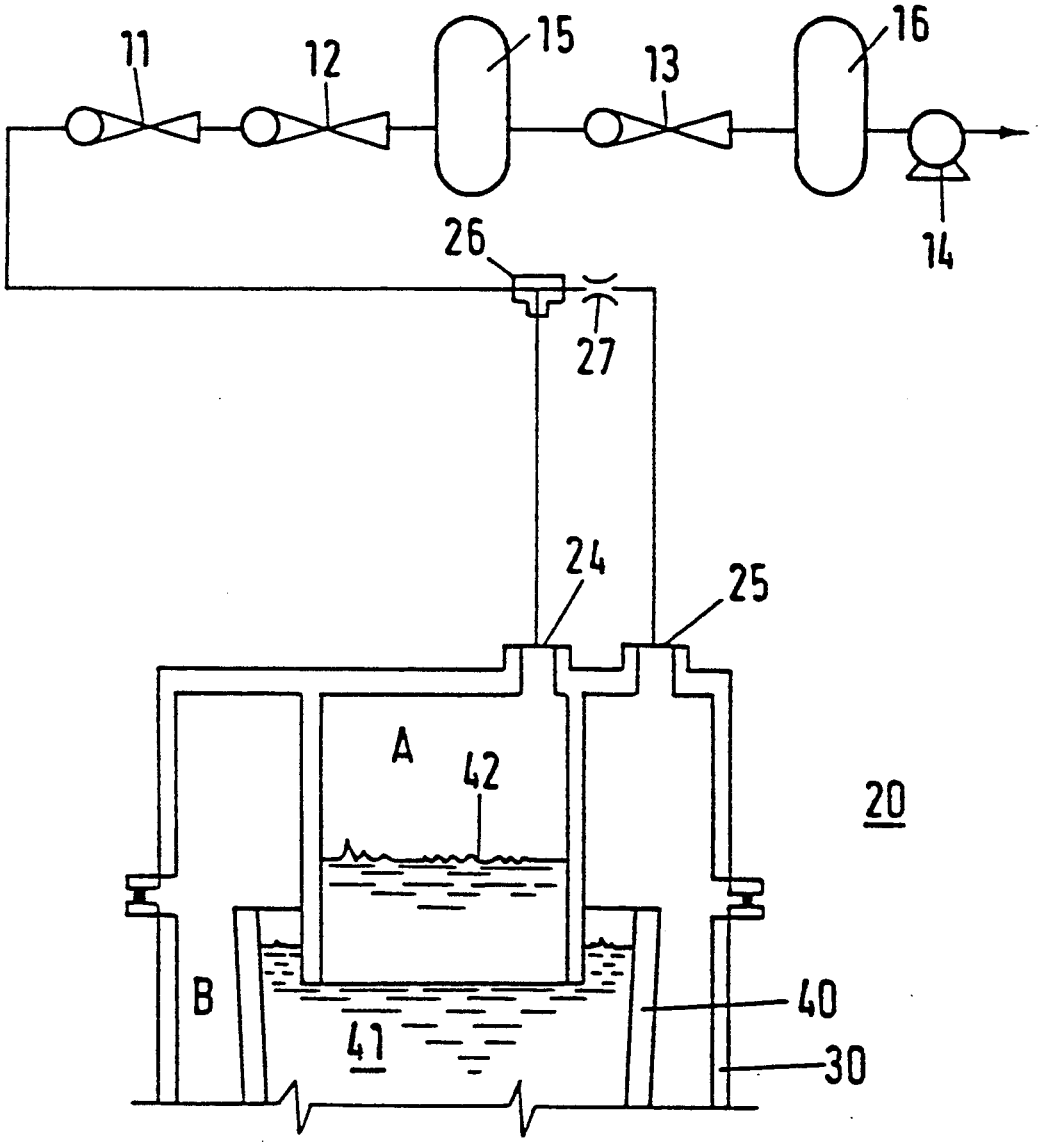
FIG. 3 shows the connection of the vacuum treatment vessel to the vacuum generator via a branch and throttle.

FIG. 3 shows the essential elements of FIG. 1, with the distinction that there is a connection from the connection 24 to the open space A by means of a branch 26, which is simultaneously connected to the connection 25 of the open space B, whereby there is a throttle 27 between the branch 26 and the connection 25.

One aspect of the invention resides broadly in a process for the vacuum treatment of metals, in particular steel, in which molten metal is in a vacuum treatment vessel tightly sealed by the cover, whereby the surface of the molten metal is divided into a circular sector and a ring-shaped sector surrounding the latter, and the molten metal is exposed to different vacuum pressures on its surface during the vacuum treatment, characterized by the fact that a lower vacuum pressure is applied to the ring-shaped sector than to the circular sector, and that the separation of the sectors is made to an immersion depth in the molten bath between 10–20 cm measured, starting from the ring-shaped sector.

Another aspect of the invention resides broadly in a process characterized by the fact that a difference of the vacuum pressure between the ring-shaped and the circular sector is selected which corresponds to at least one-half of a pressure stage of the vacuum system.

Yet another aspect of the invention resides broadly in an apparatus for the performance of a process with a vacuum treatment vessel which has a cover equipped with a gasket, and which is connected to a multi-stage vacuum generation system, whereby a ladle filled with molten metal can be introduced into the vacuum treatment vessel, characterized by the fact that the cover 20 has a cylindrical skirt 21 oriented parallel to the center axis 1 of the cover 20, whose peripheral region 22 projects into the molten metal 41 when the ladle 40 is filled, and the diameter of which is only slightly less than the diameter of the ladle at the immersion level, that there are connections 24, 25 between the vacuum system 10 and the open space A separated by the skirt 21 surrounded by the circular portion 23 of the cover 20—when the ladle 40 is filled—by the circular surface 42 of the molten metal, and with the open space B, which is surrounded by the ring-shaped portion 29 of the cover 20, the vacuum treatment vessel 30, the ladle 40 and—when the ladle is filled—by the ring-shaped surface 43 of the molten metal, where the connection 24 to the empty space A is connected on an ejector 11 having the highest pressure stage of the vacuum system 10, and the connection 25 to the empty space B is made to the ejector 12 having at least the second-highest pressure stage of the vacuum system 10.

A further aspect of the invention resides broadly in an apparatus characterized by the fact that on the connection 25 to the open space A, there is a branch 26 equipped with throttle elements 27 and which is connected to the open space B.

A yet further aspect of the invention resided broadly in an apparatus characterized by the fact that the cover 20 has a ring-shaped opening 28 and that there are adjustment elements 51 on the cover 20, through which the skirt 21 can be moved parallel to the center axis 1.

Yet another further aspect of the invention resides broadly in an apparatus characterized by the fact that compensators 53 are fastened gas-tight between the ring-shaped portion 29 of the cover 20 and the edge 23 of the skirt 21 pointing away from the ladle 4.

An additional aspect of the invention resides broadly in an apparatus characterized by the fact that at least one electrode 60 can be introduced through the cover 20.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The appended drawings in their entirety, including all dimensions, proportions and/or shapes in at least one embodiment of the invention, are accurate and to scale and are hereby incorporated by reference into this specification.

The invention as described hereinabove in the context of the preferred embodiments is not to be taken as limited to all of the provided details thereof, since modifications and variations thereof may be made without departing from the spirit and scope of the invention.

What is claimed is:

1. Process for the vacuum treatment of steel, in which molten metal is in a vacuum treatment vessel tightly sealed by a cover, whereby the surface of the molten metal is divided into a circular sector and a ring-shaped sector surrounding the latter, and the molten metal is exposed to different partial vacuums on its surface during the vacuum treatment, wherein a lower partial vacuum is applied to the ring-shaped sector than to the circular sector, and that the separation of the sectors is made to an immersion depth in the molten bath between 10–20 cm measured, starting from the ring-shaped sector.

2. Process according to claim 1, wherein a difference of the vacuum pressure between the ring-shaped and the circular sector is selected which corresponds to at least one-half of a pressure stage of the vacuum system.

3. Apparatus for the vacuum treatment of steel, said apparatus comprising:

a vacuum treatment vessel which has a cover equipped with a gasket, and which is connected to a multi-stage vacuum generation system, whereby a ladle filled with molten metal can be introduced into the vacuum treatment vessel, the cover has a cylindrical skirt oriented parallel to the center axis of the cover, whose peripheral region projects into the molten metal when the ladle is filled, and the diameter of which is only slightly less than the diameter of the ladle at the immersion level, wherein:

there are connections (24, 25) between the vacuum system (10) and:

the open space (A) separated by the skirt (21) surrounded by the circular portion (23) of the cover (20)—when the ladle (40) is filled—by the circular surface (42) of the molten metal, and with the open space (B), which is surrounded by the ring-shaped portion (29) of the cover (20), the vacuum treatment vessel (30), the ladle (40) and—when the ladle is filled—by the ring-shaped surface (43) of the molten metal, where the connection (24) to the empty space (A) is connected on an ejector (11) providing the highest partial vacuum of the vacuum system (10), and the connection (25) to the empty space (B) is made to the ejector (12) on a section of the vacuum system (10) providing a smaller partial vacuum than on connection 24.

4. Apparatus according to claim 3, wherein:

on the connection (25) to the open space (A), there is a branch (26) equipped with throttle elements (27) and which is connected to the open space (B).

5. Apparatus according to claim 3, wherein:

the cover (20) has a ring-shaped opening (28) and that there are adjustment elements (51) on the cover (20), through which the skirt (21) can be moved parallel to the center axis (1).

6. Apparatus according to claim 5, wherein:

compensators (53) are fastened gas-tight between the ring-shaped portion (29) of the cover (20) and the circle-shaped part (23) of it in the shape of edge (23) of the skirt (21) pointing away from the ladle (40).

7. Apparatus according to claim 3, wherein:

at least one electrode (60) can be introduced through the cover (20).

8. Apparatus according to claim 4, wherein at least one electrode (60) can be introduced through the cover (20).

9. Apparatus according to claim 5, wherein at least one electrode (60) can be introduced through the cover (20).

10. Apparatus according to claim 6, wherein:

at least one electrode (60) can be introduced through the cover (20).

11. Process according to claim 1, comprising the steps of:

providing a vacuum treatment vessel which has a cover equipped with a gasket, providing a multi-stage vacuum generation system, connecting the vacuum treatment vessel to the multi-stage vacuum generation system, providing a ladle for being filled with molten metal, filling the ladle with molten metal, introducing the ladle, filled with molten metal, into the vacuum treatment vessel, configuring the cover to have a cylindrical skirt oriented parallel to the center axis of the cover, whose peripheral region projects into the molten metal when the ladle is filled, and the diameter of which is only slightly less than the diameter of the ladle at the immersion level, wherein said process further comprises the steps of:

providing connections (24, 25) between the vacuum system (10) and:

an open space (A) separated by the skirt (21) surrounded by the circular portion (23) of the cover (20)—when the ladle (40) is filled—by the circular surface (42) of the molten metal, and an open space (B), which is surrounded by the ring-shaped portion (29) of the cover (20), the vacuum treatment vessel (30), the ladle (40) and—when the ladle is filled—by the ring-shaped surface (43) of the molten metal, wherein the connection (24) to the empty space (A) is connected on an ejector (11) providing the highest partial vacuum of the vacuum system (10), and the connection (25) to the empty space (B) is made to the ejector (12) on a section of the vacuum system (10) with a smaller partial vacuum than on connection (24).

12. Process according to claim 11, further comprising:

providing, on the connection (25) to the open space (A), a branch (26);

equipping the branch with throttle elements (27); and connecting the branch to the open space (B).

13. Process according to claim 11, further comprising:

configuring the cover (20) to have a ring-shaped opening (28);

providing adjustment elements (51) on the cover (20), by means of which adjustment elements the skirt (21) can be moved parallel to the center axis (1).

14. Process according to claim 13, further comprising:

providing compensators (53) for being fastened gas-tight between the ring-shaped portion (29) of the cover (20) and the circle-shaped part (23) of it in the shape of edge (23) of the skirt (21) pointing away from the ladle (40).

15. Process according to claim 14, further comprising the step of:

providing at least one electrode (60) for being introduced through the cover (20).

16. Process according to claim 11, further comprising:

providing at least one electrode (60) for being introduced through the cover (20); and introducing the at least one electrode through the cover.

17. Process according to claim 12, further comprising:

providing at least one electrode (60) for being introduced through the cover (20); and introducing the at least one electrode through the cover.

18. Process according to claim 13, further comprising:

providing at least one electrode (60) for being introduced through the cover (20); and introducing the at least one electrode through the cover.

19. Method for the vacuum treatment of molten metal, said method comprising the steps of:

providing a ladle for holding the molten metal;

conducting the molten metal in the ladle, the molten metal having an upper surface when disposed in the ladle;

providing a vacuum treatment vessel;

disposing the ladle, with the molten metal, within the vacuum treatment vessel;

sealing the vacuum treatment vessel;

providing means for applying at least one partial vacuum at the upper surface of the molten metal for degassing the molten metal;

providing means for dividing the upper surface of the molten metal into a first portion and a second portion;

configuring the dividing means such that the first portion of the upper surface of the molten metal surrounds the second portion of the upper surface of the molten metal;

configuring the means for applying at least one partial vacuum to apply a first partial vacuum to the first portion of the upper surface of the molten metal and a second, different, partial vacuum to the second portion of the upper surface of the molten metal;

applying the first partial vacuum to the first portion of the upper surface of the molten metal and the second partial vacuum to the second portion of the upper surface of the molten metal; and immersing the dividing means in the molten metal to a depth at which flow conditions within the molten metal are not significantly disrupted.

20. The method according to claim 19, wherein the ladle has a diameter at an upper portion thereof, said method further comprising the steps of:

immersing the dividing means in the molten metal to a depth of between about 10 centimeters and about 20 centimeters with respect to the second portion of the upper surface of the molten metal;

configuring the means for applying at least one partial vacuum such that, during said step of applying the first partial vacuum and the second partial vacuum, the first partial vacuum is greater than the second partial vacuum, thereby resulting in a lower absolute pressure at the first portion of the upper surface of the molten metal than at the second portion of the upper surface of the molten metal;

configuring the dividing means such that, when the dividing means is immersed in the molten metal, the first portion of the upper surface of the molten metal completely surrounds the second portion of the upper surface of the molten metal;

providing a cover for covering the vacuum treatment vessel;

configuring the cover of the vacuum treatment vessel to comprise the dividing means;

configuring the dividing means to comprise skirt means for extending downwardly towards the molten metal, the skirt means for being immersed in the molten metal;

configuring the skirt means to comprise a generally cylindrical shape, the skirt means having a radius and a diameter;

configuring the dividing means such that, when the dividing means is immersed in the molten metal, the first portion of the upper surface of the molten metal is generally ring-shaped and the second portion of the upper surface of the molten metal is generally circular in shape, the first portion of the upper surface of the molten metal having a width;

configuring the dividing means such that, when the dividing means is immersed in the molten metal, the first portion of the upper surface of the molten metal has a surface area substantially less than that of the second portion of the upper surface of the molten metal;

configuring the skirt means such that the diameter thereof is slightly less than the diameter of the ladle configuring the skirt means such that, when the skirt means is immersed in the molten metal, the ratio of the radius of the skirt means to the width of the first portion of the upper surface of the molten metal is between about 8:1 and about 122:1;

configuring the means for applying at least one partial vacuum to provide a pressure difference, between the first partial vacuum and the second partial vacuum, of between about ½ and about 2 stages;

providing, during said step of applying the first partial vacuum and the second partial vacuum, a pressure difference, between the first partial vacuum and the second partial vacuum, of between about ½ and about 2 stages;

providing means for vertically adjusting the skirt means, to vary the depth of immersion of the skirt means;

vertically adjusting the skirt means to vary the depth of immersion of the skirt means;

configuring the cover to comprise a first portion and a second portion, the first portion of the cover being generally ring-shaped and the second portion of the cover being generally circular in shape;

configuring the cover such that the skirt means extends downwardly from the second portion of the cover;

providing a plurality of compensators for being fastened in a gas-tight manner between the first portion of the cover and the second portion of the cover to provide a gas-tight seal between the first portion of the cover and the second portion of the cover;

providing at least one electrode for being introduced through the cover;

introducing the at least one electrode through the cover.

* * * * *